US008590754B2

(12) United States Patent
Tani

(10) Patent No.: US 8,590,754 B2
(45) Date of Patent: Nov. 26, 2013

(54) FILLING MATERIAL EXTRUDING CONTAINER

(75) Inventor: Yoshikazu Tani, Kawaguchi (JP)

(73) Assignee: Tokiwa Corporation, Gifu (JP)

( * ) Notice: Subject to any disclaimer, the term of this patent is extended or adjusted under 35 U.S.C. 154(b) by 152 days.

(21) Appl. No.: 13/159,535

(22) Filed: Jun. 14, 2011

(65) Prior Publication Data

US 2011/0315719 A1 Dec. 29, 2011

(30) Foreign Application Priority Data

Jun. 28, 2010 (JP) ..... 2010-146082

(51) Int. Cl.
*B05C 17/01* (2006.01)

(52) U.S. Cl.
USPC ..... 222/390

(58) Field of Classification Search
USPC ..... 222/390; 401/68–75
See application file for complete search history.

(56) References Cited

U.S. PATENT DOCUMENTS

| | | | | |
|---|---|---|---|---|
| 7,731,440 | B2 * | 6/2010 | Tani | 401/75 |
| 7,891,896 | B2 * | 2/2011 | Nasu | 401/68 |
| 8,104,984 | B2 * | 1/2012 | Tani | 401/70 |
| 8,172,472 | B2 * | 5/2012 | Tani | 401/78 |
| 8,277,136 | B2 * | 10/2012 | Tani | 401/78 |
| 8,328,447 | B2 * | 12/2012 | Tani | 401/172 |
| 2008/0237932 | A1 * | 10/2008 | Tani | 264/334 |

* cited by examiner

*Primary Examiner* — Paul R Durand
*Assistant Examiner* — Donnell Long
(74) *Attorney, Agent, or Firm* — Bacon & Thomas, PLLC

(57) ABSTRACT

To secures a sufficient movement of a moving body, a filling material extruding container (100) has a rotation stop tube (4) engaging with a main body tube (2) in a rotating direction, a moving screw tube (5) engaging with a control tube (3) in a rotating direction, first screw portion (8) having protruding strips (41*a*) in the rotation stop tube (4) and the protruding strips (52) on the moving screw tube (5) and serving as a click mechanism generating a click feeling by engagement and engagement cancellation, and a second screw portion (9) having a female screw (51) in the moving screw tube (5) and a male screw (66) on the moving body (6), and the rotation stop tube (4) has a through hole (45) engaging with the moving body (6) in the rotating direction, at a front side of the protruding strips (41*a*).

11 Claims, 6 Drawing Sheets

FILLING MATERIAL EXTRUDING CONTAINER

BACKGROUND OF THE INVENTION

1. Field of the Invention

The present invention relates to a filling material extruding container which is used by extruding a filling material.

2. Description of the Conventional Art

As a conventional filling material extruding container, for example, there has been known a structure described in Japanese Unexamined Patent Publication No. 2009-39174. In this filling material extruding container, if a main body tube (a front portion of the container) and an operation tube (a rear portion of the container) are relatively rotated, screwing actions of a screw portion and another screw portion work together, and a moving body moves for a predetermined distance. If they are thereafter further rotated relatively, the moving body further moves only on the basis of the screwing action of the screw portion. In the filling material extruding container mentioned above, when the moving body further moves only on the basis of the screwing action of the screw portion, the other screw portion acts as a click mechanism. In other words, engagement and engagement cancellation of a male screw and a female screw (a pair of click projections) in the other screw portion are repeated, and a click feeling is generated. Accordingly, it is intended to make a user detect a degree of the relative rotation and a moving degree of the moving body.

Further, in the filling material extruding container described in Japanese Unexamined Patent Publication No. 2009-39174, a shaft body provided in a rear portion of the container is inserted into the moving body so as to be engaged with the moving body in a rotating direction, and the shaft body serves as a rotation stop portion moving the moving body in cooperation with the screwing action of the screw portion.

SUMMARY OF THE INVENTION

Problem to be Solved by the Invention

In this case, in the filling material extruding container mentioned above, in the case of securing a sufficient forward moving distance (an feeding amount) of the moving body, it is necessary to engage the rotation stop portion with the moving body in the rotating direction until the moving body moves forward sufficiently. In this regard, in the filling material extruding container mentioned above, it is general that the rotation stop portion is provided in the rear portion of the container as mentioned above, for example, for the reason of a structure in relation to the screw portion and the click mechanism. Therefore, it is not always easy to engage the rotation stop portion with the moving body until the moving body moves forward sufficiently, and there is a case that it becomes hard to secure a sufficient moving distance of the moving body.

Accordingly, an object of the present invention is to secure a sufficient moving distance of a moving body in a filling material extruding container in which the moving body can move with generating a click feeling.

Means for Solving the Problem

In order to achieve the object mentioned above, in accordance with the present invention, there is provided a filling material extruding container having therein a filling material and a moving body for moving the filling material, the moving body moving on the basis of a screwing action of a screw portion while generating a click feeling, if a front portion of the container and a rear portion of the container are relatively rotated, wherein the container comprises:

a front tube which is arranged within the container and engages with the front portion of the container in a rotating direction;

a rear tube which is arranged within the container and engages with the rear portion of the container in a rotating direction; and a click mechanism which has pairs of click projections and generates the click feeling on the basis of engagement and engagement cancellation of the pairs of the click projections, and wherein one side of the screw portion is provided in the rear tube, the other side of the screw portion is provided on the moving body, one side of the pairs of the click projections is provided in the front tube, the other side of the pairs of the click projections is provided on the rear tube, the front tube has a rotation engagement portion engaging with the moving body in a rotating direction as a rotation stop portion moving the moving body in cooperation with the screwing action of the screw portion, and the rotation engagement portion is provided at a front side of the one side click projections in the front tube in such a manner as to engage with a front end portion of the moving body in an initial state.

In the present invention structured as mentioned above, in the filling material extruding container provided with the screw portion and the click mechanism, the rotation engagement portion is provided as the rotation stop portion in the front tube engaging with the front portion of the container in the rotating direction, and the rotation engagement portion is provided at the front side of the one side click projections in such a manner that it engages with the front end portion of the moving body in the initial state. Accordingly, it is possible to preferably engage the rotation engagement portion as the rotation stop portion with the moving body. As a result, in the present invention, it is possible to secure a sufficient moving distance of the moving body in the filling material extruding container in which the moving body can move with generating the click feeling.

At this time, as a structure which can achieve the operation and effect mentioned above, specifically, there is such a structure that the pairs of the click projections construct another screw portion which is different from the screw portion, and the moving body further moves on the basis of only the screwing action of the screw portion while generating the click feeling, after the moving body moves for a predetermined distance on the basis of the screwing actions of the screw portion and the other screw portion, if the front portion of the container and the rear portion of the container are relatively rotated.

Further, it is preferable that the rear tube is provided with protruding portions engaging with the rear portion of the container in the rotating direction, and the protruding portions have elasticity in a radial direction to cancel the engagement with the rear portion of the container in the case that the rear portion of the container and the rear tube are relatively rotated by greater rotating force than predetermined rotating force. Accordingly, even in the case that the rear portion of the container and the rear tube are relatively rotated by the greater rotating force than the predetermined rotating force for some reason, it is possible to make the protruding portions serve as a torque limiter so as to prevent the container from being broken by the rotating force mentioned above.

Further, it is preferable that the click mechanism is provided with an elastic portion energizing the rear tube in such a manner that the pairs of the click projections engage with each other, and the elastic portion is formed by a slit extending spirally along an outer peripheral surface in the rear end portion of the front tube. In this case, it is possible to form the elastic portion of the click mechanism integrally with the front tube.

Further, the moving body is formed in a columnar shape having a non-circular cross sectional shape and extending in an axis direction, and the rotation engagement portion has a through hole portion to which the moving body is inserted and which is formed in a non-circular shape corresponding to the cross sectional shape of the moving body. In this case, since the conventional filling material extruding container mentioned above is structured such that the rotation stop portion is inserted, as the shaft body, into the moving body as mentioned above, it is necessary to set a size of the moving body (particularly, a diameter of the moving body) to be a fixed level or more. On the contrary, in the present invention, the rotation engagement portion is engaged, as the rotation stop portion, with the moving body in the rotating direction, by inserting the moving body into the through hole portion having the non-circular shape. Accordingly, it is not necessary to insert the rotation stop portion as the shaft body into the moving body, whereby it is possible to make the container compact.

Effect of the Invention

In accordance with the present invention, it is possible to secure a sufficient forward moving distance of the moving body in the filling material extruding container in which the moving body can move with generating the click feeling,

DETAILED DESCRIPTION OF PREFERRED EMBODIMENT

Figure 1:
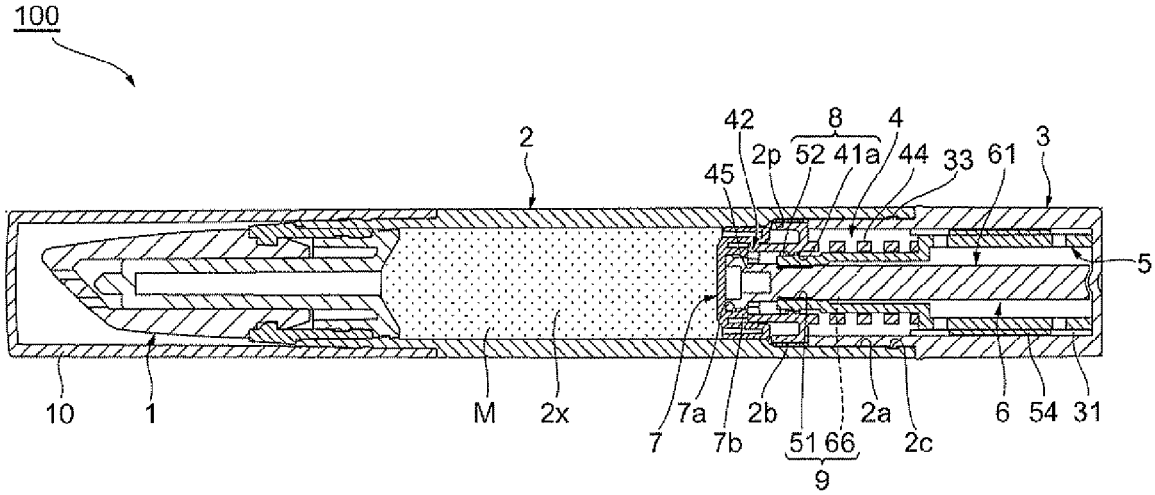
FIG. 1 is a longitudinal sectional view showing an initial state of a filling material extruding container in accordance with an embodiment of the present invention.

A description will be in detail given below of a preferable embodiment in accordance with the present invention with reference to the accompanying drawings. In this case, in the following description, the same reference numerals are attached to the same or corresponding elements, and an overlapping description will be omitted.

Figure 2:
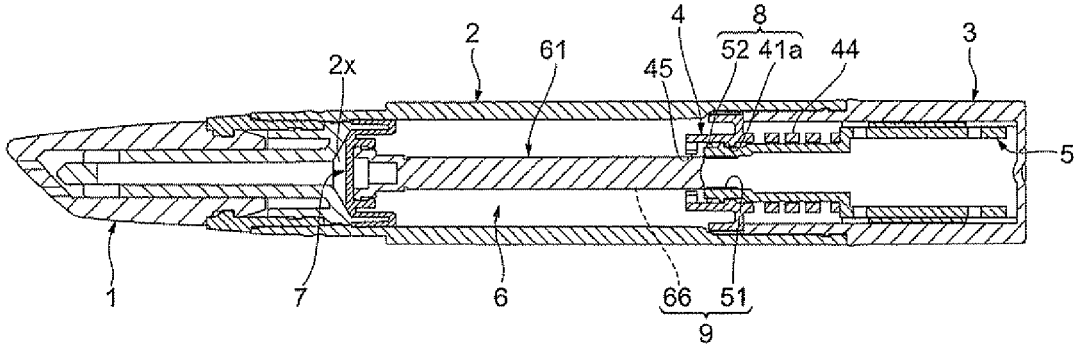
FIG. 2 is a longitudinal sectional view showing a state of a piston forward moving limit of the filling material extruding container in FIG. 1.

FIG. 1 is a longitudinal sectional view showing an initial state of a filling material extruding container in accordance with an embodiment of the present invention, and FIG. 2 is a longitudinal sectional view showing a state of a piston forward moving limit of the filling material extruding container in FIG. 1. As shown in FIGS. 1 and 2, a filling material extruding container 100 in accordance with the present embodiment contains a filling material M, and can extrude and retract it on the basis of an operation of a user.

The filling material M can be a semisolid or a soft solid material such as those in a liquid state, a jelly state, a gel state, a kneaded state including a paste state or the like, for example, a lip gloss, a lip stick, an eye color, an eye liner, a cosmetic liquid, a cleaning fluid, a cleansing oil, a nail enamel, a nail care liquid solution, a nail enamel remover, a mascara, an anti-aging, a hair color, a hair cosmetic material, an oral care material, a massage oil, a keratotic plug remover, a foundation, a concealer, a skin cream, an ink for a writing instrument such as a marking pen, a liquid medicine, a slurry material and the like.

As shown in FIGS. 1 and 2, the filling material extruding container 100 is provided with a cylindrical main body tube 2 which is provided with a filling region 2*x* filled with the filling material M in an inner portion, an applicator 1 which is installed on a front end portion of the main body tube 2 and is used for applying the filling material M extruded from the filling region 2*x* to a skin, and a closed-end cylindrical control tube 3 which is connected in an axis direction to a rear end portion of the main body tube 2 so as to be relatively rotatable, as an external structure. A front portion of the container is constructed by the applicator 1 and the main body tube 2, and a rear portion of the container is constructed by the control tube 3. Further, a cap 10 serving as a protection member is detachably installed to a front end side of the main body tube 2 in such a manner as to cover the applicator 1. In this case, "axis" means a center line extending longitudinally through the filling material extruding container 100 (the same is applied to the below).

The filling material extruding container 100 is, roughly speaking, provided with a rotation stop tube 4, a moving screw tube 5, a moving body 6 and a piston 7 in its inner portion. The rotation stop tube 4 is structured such as to engage with the main body tube 2 in a rotating direction around the axis (hereinafter simply referred to as "rotating direction") and in the axis direction, and constructs a front tube. The moving screw tube 5 is structured such as to engage with the control tube 3 so as to be simultaneously rotatable and be relatively rotatable by greater rotating force than predetermined rotating force, and constructs a rear tube. The moving screw tube 5 is screwed with the rotation stop tube 4 via a first screw portion (a click mechanism, another screw portion) 8. The moving body 6 engages with the rotation stop tube 4 so as to be simultaneously rotatable and be movable in the axis direction, and is screwed with the moving screw tube 5 via a second screw portion (a screw portion) 9. The piston 7 is installed to a front end portion of the moving body 6 so as to form a rear end of a filling region 2*x*.

In this filling material extruding container 100, if the main body tube 2 and the control tube 3 are relatively rotated in one direction corresponding to one rotating direction, the moving screw tube 5 moves forward for a fixed distance, the moving body 6 moves forward while being accompanied by the moving screw tube 5 and simultaneously moves forward by itself with respect to the moving screw tube 5, and the piston 7 moves forward. If the main body tube 2 and the control tube 3 are further rotated relatively in the same direction after the moving screw tube 5 reaches a forward moving limit, the moving body 6 moves forward by itself, and the piston 7 moves forward. On the other hand, if the main body tube 2 and the control tube 3 are relatively rotated in the other direction corresponding to the opposite direction to the one rotating direction, the moving screw tube 5 moves rearward for a fixed distance, the moving body 6 moves rearward while being accompanied by the moving screw tube 5 and simultaneously moves rearward by itself with respect to the moving screw tube 5, and the piston 7 moves rearward.

As shown in FIG. 1, the main body tube 2 is molded with, for example, a polypropylene (PP), and is constructed in a cylindrical shape. The main body tube 2 is installed in such a manner that the applicator 1 is integrated with a front side thereof. The applicator 1 is made of, for example, a silicone rubber, is formed in a closed-end cylindrical shape in which a front side is closed, and has a front end surface formed by an inclined angle surface which inclines at a predetermined angle with respect to the axis direction. A plurality of discharge ports corresponding to through holes for discharging the filling material M are formed in the front end surface of the applicator 1. In this case, the applicator 1 may be molded with, for example, a soft material, a hard material, a foam member or the like by compression molding or injection molding, and may be formed in various shapes such as a brush shape obtained by binding a synthetic fiber, a spatula shape or the like. In other words, every applicator can be used as the applicator 1.

Further, an expanded portion 2*a* having an expanded diameter is provided in a rear end portion of a tube hole of the main body tube 2 via a step surface 2*p*. A front side in an inner peripheral surface of the expanded portion 2*a* is provided with a knurling 2*b* structured such that a lot of concavo-convex portions are arranged in parallel in a peripheral direction and the concavo-convex portions extend at a predetermined length in the axis direction, as a structure for engaging the rotation stop tube 4 in the rotating direction. On the other hand, a rear side in the inner peripheral surface of the expanded portion 2*a* is provided with an annular concave portion 2*c* for enabling the control tube to rotate relatively and engaging it in the axis direction.

Figure 3:
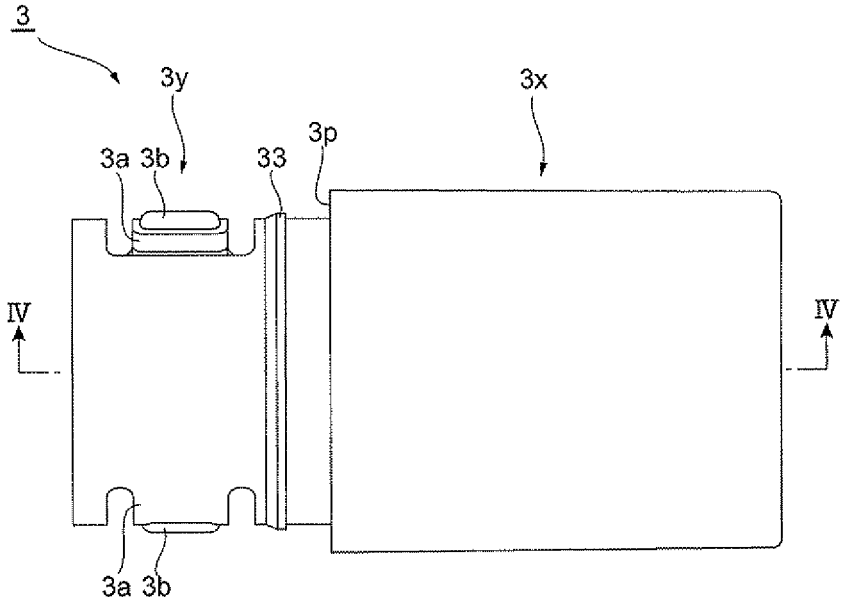
FIG. 3 is a plan view showing a control tube of the filling material extruding container in FIG. 1.
Figure 4:
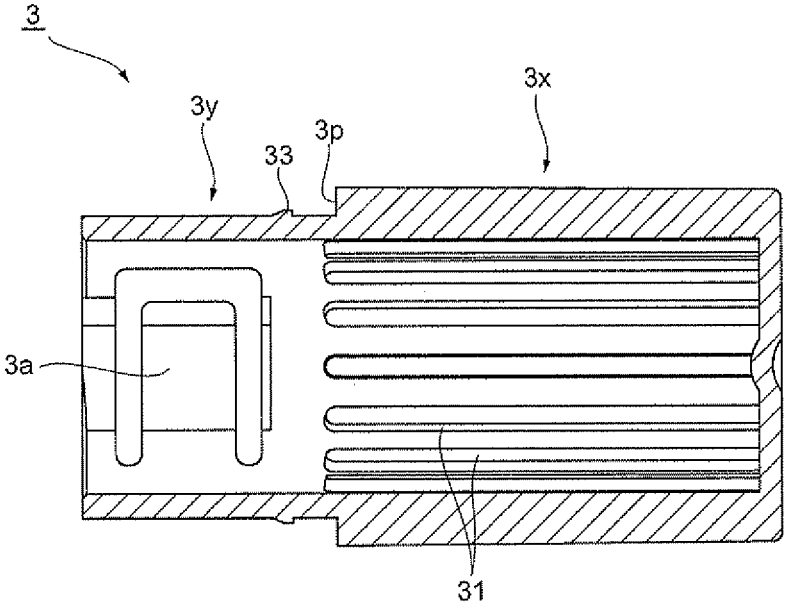
FIG. 4 is a sectional view along a line IV-IV in FIG. 3.

FIG. 3 is a plan view showing the control tube of the filling material extruding container in FIG. 1, and FIG. 4 is a sectional view along a line IV-IV of FIG. 3. As shown in FIGS. 3 and 4, the control tube 3 is molded with, for example, a copolymer synthetic resin of an acrylonitrile butadiene styrene (ABS resin), is constructed in a stepped cylindrical shape, and is provided with an outer diameter large-diameter portion 3*x* at a rear side, and an outer diameter small-diameter portion 3*y* at a front side thereof via a stepped surface 3*p*. An inner peripheral surface of the outer diameter large-diameter portion 3*x* is provided with a knurling 31 in which a lot of concavo-convex portions are arranged in parallel in a peripheral direction and the concavo-convex portions extend at a predetermined length in the axis direction, as a structure engaging with the moving screw tube 5 in the rotating direction. An annular convex portion 33 for engaging with the main body tube 2 in the axis direction is formed at a rear side in an outer peripheral surface of the outer diameter small-diameter portion 3*y*.

The control tube 3 has arms 3*a* which extend along a peripheral direction, and protruding portions 3*b* which are provided on distal end portions of the arms 3*a*. A pair of the arms 3*a* are provided at a front side of the annular convex portion 33 in the outer diameter small-diameter portion 3*y* in such a manner as to be opposed at both sides of the axis. The arms 3*a* are made in such a manner as to form C-shaped slits in the outer diameter small-diameter portion 3*y*, and apply elastic force in a radial direction caused by its raw material to the protruding portions 3*b*, by being bent in a radial direction around proximal end sides thereof. The protruding portions 3*b* are structured such as to apply fixed sliding resistance to the relative rotation between the main body tube 2 and the control tube 3, and come into contact with an inner peripheral surface in a rear side of the main body tube 2 so as to slide. The protruding portions 3*b* are formed in a convex shape toward an outer side in the radial direction, and have elastic force in the radial direction on the basis of flexibility of the arms 3*a*.

As shown in FIGS. 1, 3 and 4, the control tube 3 is structured such that the outer diameter small-diameter portion 3*y* is inserted into the main body tube 2, the stepped surface 3*p* contacts with the rear end surface of the main body tube 2, and the annular convex portion 33 engages with the annular concave portion 2*c* of the main body tube 2 in the axis direction, thereby being connected and installed to the main body tube 2 in the axis direction so as to be relatively rotatable. At this time, the protruding portions 3*b* of the control tube 3 slidably come into contact with the inner peripheral surface of the main body tube 2, and energize the inner peripheral surface of the main body tube 2 to an outer side in the radial direction on the basis of the elastic force thereof. Accordingly, when the main body tube 2 and the control tube 3 are relatively rotated, a fixed feeling of resistance is generated.

Figure 5:
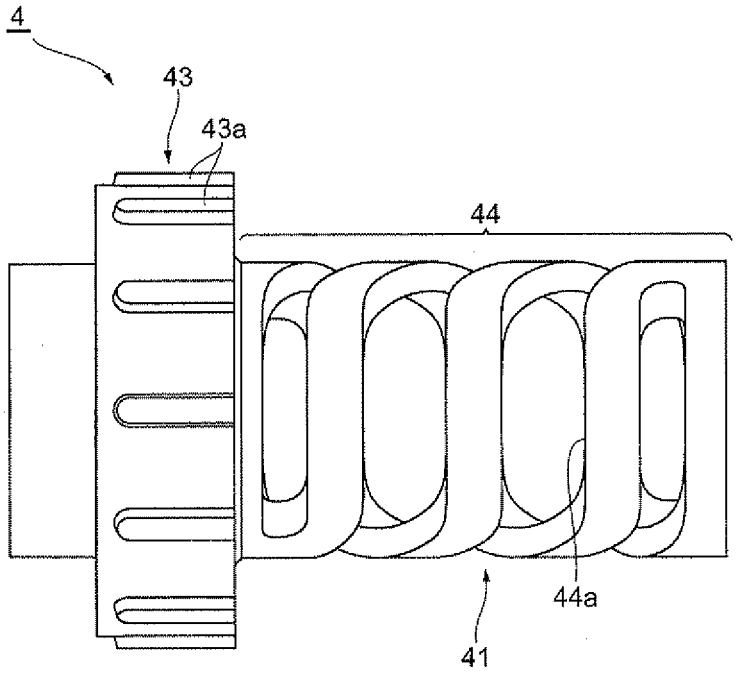
FIG. 5 is a front view showing a rotation stop tube of the filling material extruding container in FIG. 1.
Figure 6:
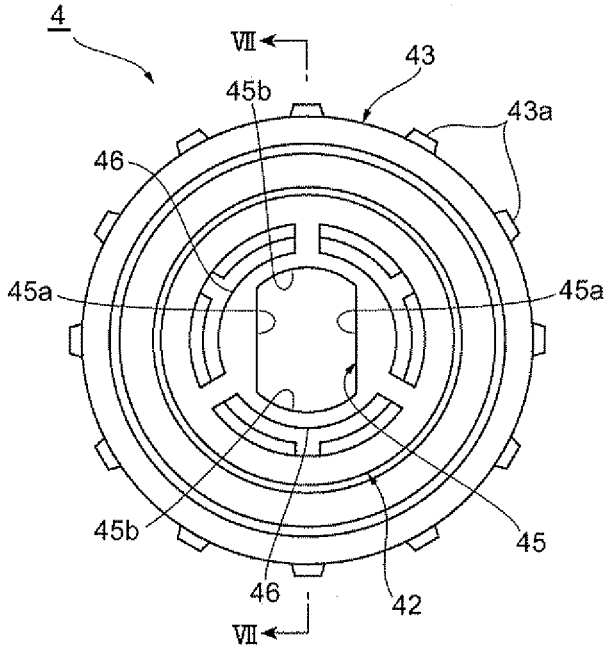
FIG. 6 is a left side view showing the rotation stop tube of the filling material extruding container in FIG. 1.
Figure 7:
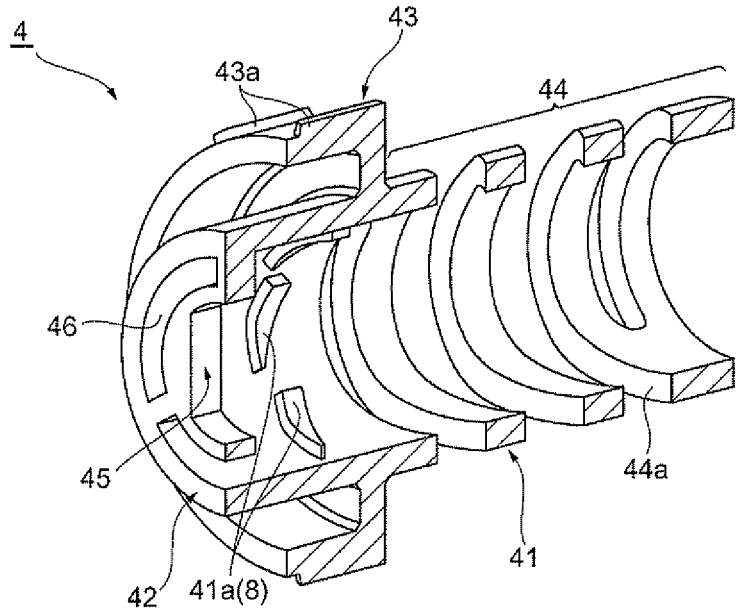
FIG. 7 is a sectional view along a line VIII-VIII in FIG. 6.

FIG. 5 is a front view showing the rotation stop tube of the filling material extruding container in FIG. 1, FIG. 6 is a left side view showing the rotation stop tube of the filling material extruding container in FIG. 1, and FIG. 7 is a sectional view along a line VIII-VIII in FIG. 6. As shown in FIGS. 5 and 7, it is molded with, for example, a polyacetal (POM). The rotation stop tube 4 is formed in a closed-end cylindrical shape which is open to a rear side. In other words, the rotation stop tube 4 is constructed to include a cylindrical tube portion 41, and a disc-shaped front plate portion 42 which is provided in such a manner as to close a front end of the tube portion 41.

A plurality of protruding strips 41*a* serving as a female screw constructing the first screw portion 8 are provided at a position which is a predetermined length apart to the rear side from the front end in the inner peripheral surface of the tube portion 41. These protruding strips 41*a* extend along the inner peripheral surface so as to form a spiral shape, and end portions of the adjacent protruding strips 41*a* and 41*a* are spaced while being shifted from each other in the axis direction. Further, the protruding strips 41*a* are intermittently provided to avoid overlapping with each other in the axis directional view.

The tube portion 41 includes a cylindrical collar portion 43 which is provided in such a manner as to cover a front end side outer periphery thereof. A plurality of protruding strips 43*a* extending at a predetermined length in the axis direction are provided in a peripheral direction, as a structure which engages with the knurling 2*b* of the main body tube 2 in the rotating direction, on an outer peripheral surface of the collar portion 43. Further, a rear side of the collar portion 43 in the tube portion 41 is made to be a spring portion 44 serving as an elastic portion (a so-called resin spring) which can be expanded and contracted in the axis direction.

The spring portion 44 is structured such as to energize the moving screw tube 5 in such a manner that the first screw portion 8 screw-returns, and is provided by forming a slit 44*a* which spirally extends along an outer peripheral surface and makes inside and outside of the tube portion 41 communicate. In this case, "screw-return" here means a stage that a male screw returns until it comes into contact with a side surface of a screw ridge of the female screw (the same applies to the below).

As shown in FIGS. 6 and 7, a through hole (a through hole portion) 45 for inserting the moving body 6 thereto is formed as a rotation engagement portion which engages the moving body 6 in the rotating direction so as to be movable in the axis direction, at a center position of the front plate portion 42. In other words, the through hole 45 is provided at a front side of the protruding strips 41*a* of the first screw portion 8 in the rotation stop tube 4. The through hole 45 is structured such as to engage with the front end portion of the moving body 6 at a time of an initial state in which the rotation stop tube 4, the moving screw tube 5 and the moving body 6 are assembled within the main body tube 2 (details will be mentioned below).

As shown in FIG. 6, the through hole 45 extends in the axis direction and is formed in a non-circular shape corresponding to a cross sectional shape of the moving body 6 as seen in the axis direction. Specifically, an edge of the through hole 45 is constructed by a pair of linear portions 45*a* which extend linearly while being opposed to each other, and circular arc portions 45*b* which extend in a circular arc shape in such a manner as to connect these linear portions 45*a*.

Further, slits 46 extending in a circular arc shape as seen in the axis direction are formed at an outer side in the radial direction of the through hole 45 in the front plate portion 42. The slits 46 are structured such as to allow core pins to pass there through for molding portions in relation to the protruding strips 41*a* (refer to FIG. 7) at a time of molding with resin the rotation stop tube 4. The slits 46 are provided at three uniformly arranged positions in the peripheral direction, for example, since it is preferable for reasons of manufacture and strength of the front plate portion 42.

As shown in FIGS. 1 and 5 to 7, the rotation stop tube 4 is inserted into the main body tube 2, a front end surface of the collar portion 43 contacts with the step surface 2*p* of the main body tube 2, and the protruding strips 43*a* thereof are engaged with the knurling 2*b* of the main body tube 2 in the rotating direction. Accordingly, the rotation stop tube 4 is installed so as to be engaged with the main body tube 2 in the rotating direction. In this case, a slight clearance is formed between a rear end surface of the collar portion 43 of the rotation stop tube 4 and a front end surface of the control tube 3, thereby inhibiting a relative rotation of the control tube 3 with respect to the main body tube 2 from being blocked by the rotation stop tube 4, and preventing the relative rotation from becoming blunt (heavy).

Figure 8:
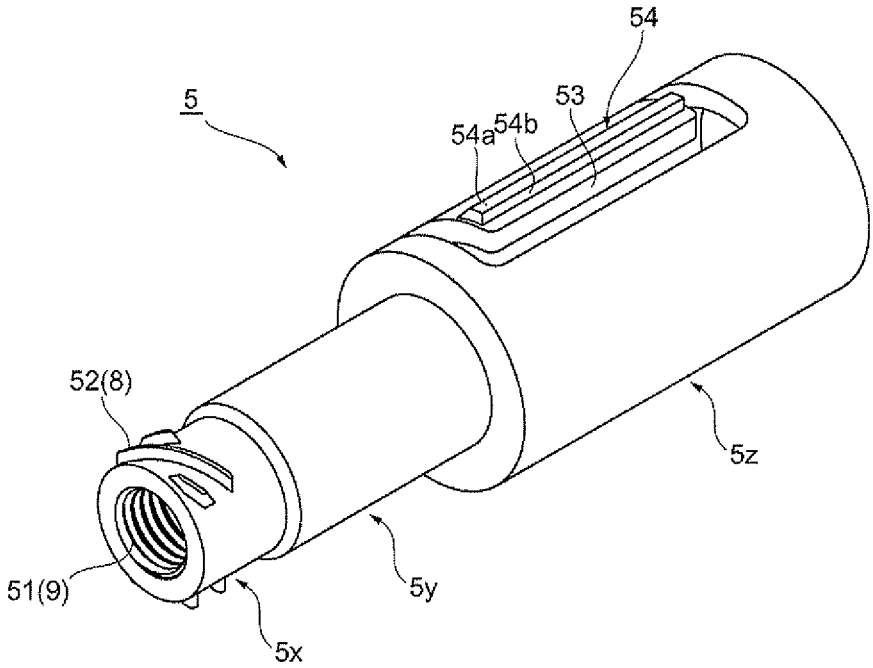
FIG. 8 is a perspective view showing a moving screw tube of the filling material extruding container in FIG. 1.
Figure 9:
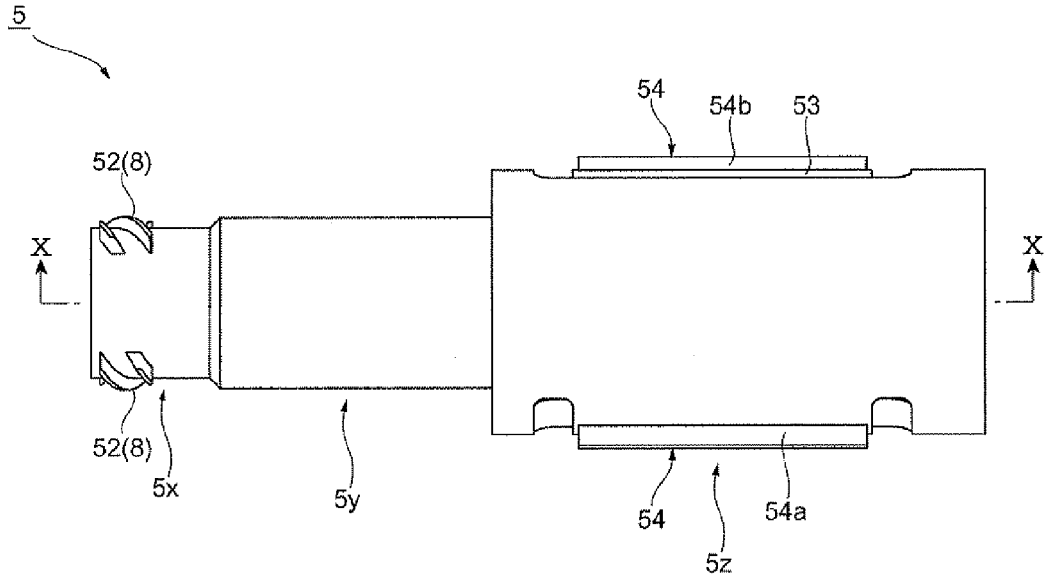
FIG. 9 is a front view showing the moving screw tube of the filling material extruding container in FIG. 1.
Figure 10:
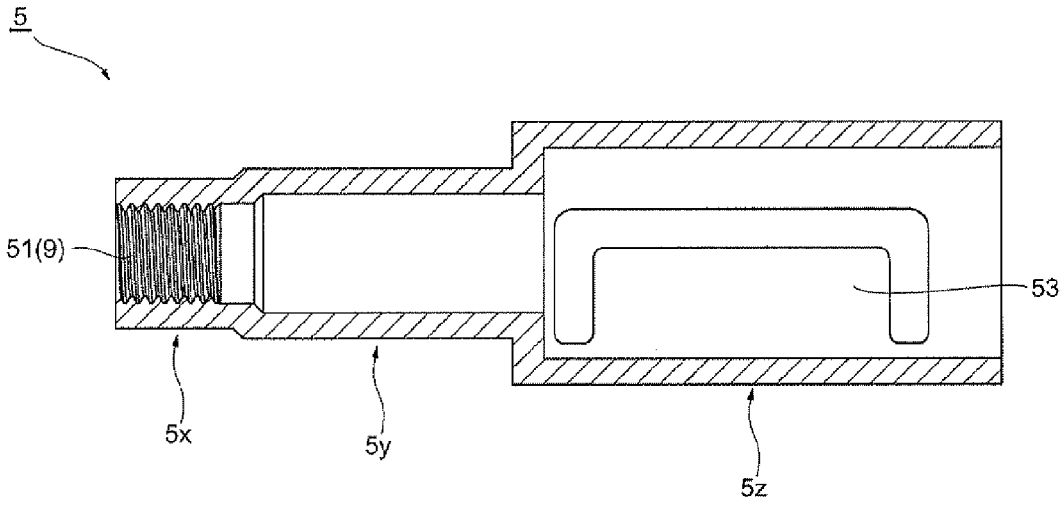
FIG. 10 is a sectional view along a line X-X in FIG. 9.

FIG. 8 is a perspective view showing the moving screw tube of the filling material extruding container in FIG. 1, FIG. 9 is a front view showing the moving screw tube of the filling material extruding container in FIG. 1, and FIG. 10 is a sectional view along a line X-X in FIG. 9. As shown in FIG. 8, the moving screw tube 5 is molded with, for example, the POM. The moving screw tube 5 is constructed in a stepped cylindrical shape, and includes a front end portion 5*x*, an intermediate portion 5*y* having a larger diameter outer shape than the front end portion 5*x*, and a rear end portion 5*z* having a larger diameter outer shape than the intermediate portion 5*y*. As shown in FIG. 10, an inner diameter of the moving screw tube 5 is expanded in a stepped shape correspondingly to an outer diameter from a front side to a rear side.

A female screw 51 constructing the second screw portion 9 is provided in a region extending rearward at a predetermined length from a front end in the inner peripheral surface of the front end portion 5*x*. In this case, a pitch of the second screw portion 9 here is made smaller than a pitch of the first screw portion 8, and a lead (a distance of propulsion by one rotation of relative rotation between the main body tube 2 and the control tube 3) of the first screw portion 8 is made to be larger than a lead of the second screw portion 9.

Protruding strips 52 serving as the male screw constructing the first screw portion 8 are provided on an outer peripheral surface of the front end portion 5*x*. The protruding strips 52 are provided on a pair of opposed portions which are opposed at both sides of the axis in the outer peripheral surface. In other words, they are intermittently provided in such a manner as to extend to form a spiral shape only on the opposed portions.

The rear end portion 5*z* has arms 53 which extend along a peripheral direction, and protruding strips (protruding portions) 54 which are provided on a distal end portions of the arms 53 and extend in the axis direction. A pair of arms 53 are provided in such a manner as to be opposed at both sides the axis. The arms 53 are structured in such a manner as to form C-shaped slits in the rear end portion 5*z*, and apply elasticity in a radial direction caused by its raw material to the protruding strips 54 by being bent in a radial direction around the proximal end side thereof.

The protruding strips 54 are structured such as to engage in a rotating direction with the knurling 31 (refer to FIG. 4) of the control tube 3, and have elastic force in a radial direction on the basis of flexibility of the arm 53. As shown in FIG. 8, the protruding strips 54 are formed in a convex shape outward in the radial direction. Specifically, side surfaces 54*b* at one side (a side coming into contact with the knurling 31 at a time of relatively rotating the main body tube 2 and the control tube 3 in one direction) in a peripheral direction of the protruding strips 54 intersect vertically with the outer peripheral surface. On the other hand, side surfaces 54*a* at the other side (a side coming into contact with the knurling 31 at a time of relatively rotating the main body tube 2 and the control tube 3 in the other direction) in the peripheral direction of the protruding strips 54 incline with respect to the outer peripheral surface so as to form a chevron shape.

As shown in FIGS. 1 and 8 to 10, the moving screw tube 5 is inserted into the rotation stop tube 4 from a rear side of the rotation stop tube 4, and the protruding strips 52 are screwed with the protruding strips 41*a* of the rotation stop tube 4, thereby being installed to the rotation stop tube 4 via the first screw portion 8. At this time, the moving screw tube 5 contacts with the rear end surface of the rotation stop tube 4 at the stepped surface 5*p* between the intermediate portion 5*y* and the rear end portion 5*z*, and is always energized rearward in the axis direction by elastic force caused by contraction (compression) of the spring portion 44 of the rotation stop tube 4. Accordingly, particularly, when the moving screw tube 5 moves forward for a predetermined distance and the screwing action of the first screw portion 8 is cancelled, the moving screw tube 5 is energized rearward in such a manner that the first screw portion 8 screw-returns (details will be mentioned below).

In this case, if the moving screw tube 5 is always energized rearward in the axis direction on the basis of the elastic force of the spring portion 44, the rotation stop tube 4 itself is always energized forward in the axis direction on the basis of its reaction. Accordingly, the rotation stop tube 4 engages in the axis direction as well as in the rotating direction with the main body tube 2. As a result, the rotation stop tube 4 is installed to the main body tube 2 in such a manner as to be integrated.

Further, the moving screw tube 5 is inserted into the control tube 3 from the front side of the control tube 3, and the protruding strips 54 thereof engage with the knurling 31 of the control tube 3 in the rotating direction, thereby the moving screw tube 5 being installed so as to engage in the rotating direction and be movable in the axis direction with respect to the control tube 3. At this time, since the protruding strips 54 have elasticity in the radial direction, the engagement with the knurling 31 of the control tube 3 is cancelled in the case that the control tube 3 and the moving screw tube 5 are relatively rotated by rotating force which is predetermined rotating force or more (details will be mentioned below).

Figure 11:
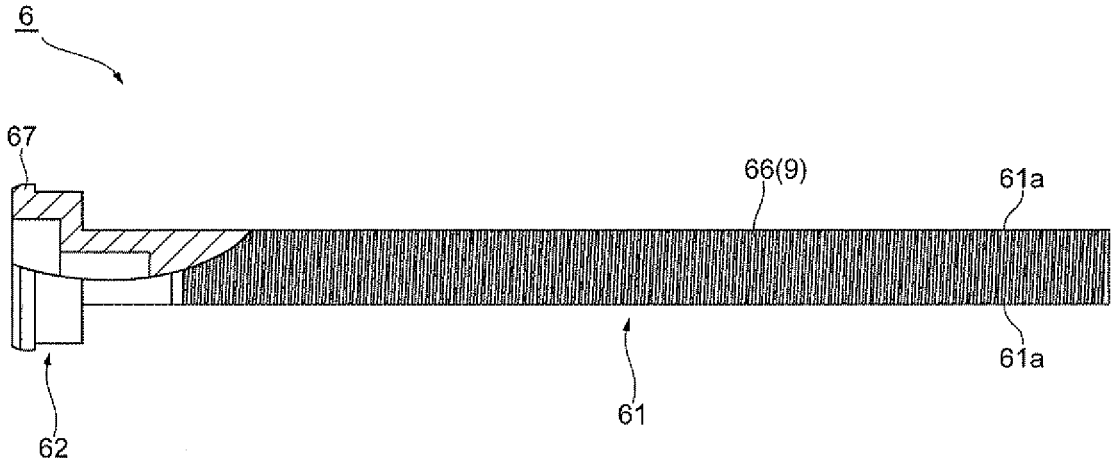
FIG. 11 is a front view showing a moving body of the filling material extruding container in FIG. 1.
Figure 12:
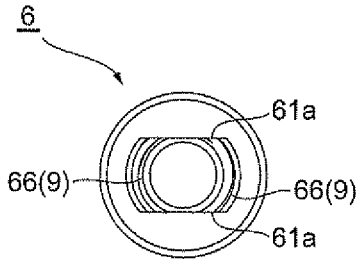
FIG. 12 is a right side view showing the moving body of the filling material extruding container in FIG. 1.

FIG. 11 is a front view showing the moving body of the filling material extruding container in FIG. 1, and FIG. 12 is a right side view showing the moving body of the filling material extruding container in FIG. 1. As shown in FIGS. 11 and 12, the moving body 6 is structured such as to push the piston 7 forward to move it forward and pull the piston 7 rearward to move it rearward. The moving body 6 is molded with, for example, the POM, and is provided with a columnar shaft body 61 which extends in the axis direction. The shaft body has a non-circular cross sectional shape corresponding to the shape of the through hole 45 of the rotation stop tube 4. Specifically, the shaft body 61 is formed in a long shaft shape having opposed two flat surface portions 61*a* and 61*a* on an outer periphery of the columnar shape.

A male screw 66 constructing the second screw portion 9 is provided in the other region than the front end portion in the outer peripheral surface except the two flat surface portions 61*a* and 61 of the shaft body 61. Further, the moving body 6 has a circular collar portion 62 provided at a front end side of the shaft body 61 as a structure for making the piston 7 engage in the axis direction. An annular convex portion 67 engaging with the piston 7 in the axis direction is provided on a front end side of an outer peripheral surface of the collar portion 62.

As shown in FIGS. 1, 11 and 12, the moving body 6 is inserted into the moving screw tube 5, and the male screw 66 is screwed with the female screw 51 of the moving screw tube 5, thereby the moving body 6 being installed to the moving screw tube 5 via the second screw portion 9. In conjunction with this, in the moving body 6, the shaft body 61 having the non-circular cross sectional shape is inserted into the through hole 45 of the rotation stop tube 4, thereby the moving body 6 being installed so as to be simultaneously rotatable and be movable in the axis direction with respect to the rotation stop tube 4. The moving body 6 here is installed in such a manner that the front end portion of the shaft body 61 engages with the through hole 45 of the rotation stop tube 4 in the rotating direction in its initial state.

Turning back to FIG. 1, the piston 7 is molded with, for example, the PP, a high density polyethylene (HDPE) an ultra high molecular weight polyethylene (UHMWPE), a linear low density polyethylene (LLDPE), or the like. An annular protruding portion 7*b* is provided on an inner peripheral surface of a concave portion 7*a* which is provided concavely in a rear end surface of the piston 7. The piston 7 is fitted onto a front end side of the moving body 6, and the annular protruding portion 7*b* engages with the annular convex portion 67 of the moving body 6 in the axis direction, thereby the piston 7 being installed so as to be movable at a predetermined length in the axis direction with respect to the moving body 6.

In the case of assembling the filling material extruding container 100 constructed as mentioned above, as shown in FIG. 1, the moving screw tube 5 is inserted in from a rear side of the rotation stop tube 4, and the protruding strips 52 serving as the male screw of the moving screw tube 5 are screwed with the protruding strips 41*a* serving as the female screw of the rotation stop tube 4. Further, the protruding strips 52 are moved to a position beyond the protruding strips 41*a* while the spring portion 44 being compressed (that is, there is set such a state that the protruding strips 52 come off from the front end of the protruding strips 41*a*, and the screwing action of the first screw portion 8 is cancelled), and the front end of the moving screw tube 5 is brought into contact with the front plate portion 42 of the rotation stop tube 4.

In this state, the rear end side of the moving body 6 to which the piston 7 is installed is inserted to the through hole 45 of the rotation stop tube 4. At this time, the moving body 6 is engaged in the rotating direction with the rotation stop tube 4, by the two flat surface portions 61*a* and 61*a* of the moving body 6. Further, the male screw 66 of the moving body 6 is screwed with the female screw 51 of the moving screw tube 5, the rotation stop tube 4 and the moving screw tube 5 are relatively rotated in the other direction, and the second screw portion 9 is moved forward by screwing to an initial position (until the female screw 51 screws with the front end portion of the male screw 66). Accordingly, a rotation stop tube assembly is obtained.

Subsequently, a control tube assembly is obtained by inserting the rotation stop tube assembly into the control tube 3 from a front side opening thereof and engaging the protruding strips 54 of the moving screw tube 5 with the knurling 31 of the control tube 3 in the rotating direction. Subsequently, a main body assembly is obtained by inserting the control tube assembly into the main body tube 2 from a rear side opening thereof while bringing the protruding portions 3*b* (refer to FIG. 3) of the control tube 3 into contact with the inner peripheral surface of the main body tube 2, and engaging the annular convex portion 33 of the control tube 3 with the annular concave portion 2*c* of the main body tube 2 in the axis direction. Further, the filling material N in a predetermined amount is filled in the filling region 2*x* in the main body assembly mentioned above by a filling machine (not shown) or the like from the front side opening of the main body tube 2, the applicator 1 is thereafter inserted into the main body tube 2 from the front side opening thereof so as to be assembled, and the cap 10 is detachably installed to the front end side of the main body tube 2 to cover the applicator 1, whereby the filling material extruding container 100 is completed.

Next, a description will be given of an example of operation of the filling material extruding container 100.

In the filling material extruding container 100 in accordance with the present embodiment in the initial state, the through hole 45 of the rotation stop tube 4 engages with the front end portion of the shaft body of the moving body 6, in the state in which the protruding strips 41*a* and 52 of the first screw portion 8 screw with each other, and the female screw 51 of the moving screw tube 5 screws with the front end portion of the male screw 66 of the second screw portion 9. Further, at this time, the rear end of the moving screw tube 5 and the rear end of the shaft body 61 come into contact with or come close to the bottom portion of the control tube 3.

In the filling material extruding container 100 in the initial state mentioned above, if the cap 10 is detached by a user and the main body tube 2 and the control tube 3 are relatively rotated in the one direction corresponding to the feeding direction, the side surfaces 54*b* (refer to FIG. 8) of the protruding strips 54 of the moving screw tube 5 come into contact with the knurling 31 of the control tube 3 so as to be locked (firmly engaged) in the rotating direction. Accordingly, the rotation stop tube 4 and the moving screw tube 5 relatively rotate, the screwing action of the first screw portion 8 constructed by the protruding strips 41*a* of the rotation stop tube 4 and the protruding strips 52 of the moving screw tube 5 is applied, and the moving screw tube 5 moves forward together with the moving body 6, on the basis of a cooperation with the rotation stop portion constructed by the protruding strips 54 of the moving screw tube 5 and the knurling 31 of the control tube 3.

At the same time, since the moving body 6 engages with the through hole 45 of the rotation stop tube 4 in the rotating direction, the moving body 6 and the moving screw tube 5 relatively rotate, the screwing action of the second screw portion 9 constructed by the female screw 51 of the moving screw tube 5 and the male screw 66 of the moving body 6 is applied, and the moving body 6 moves forward on the basis of a cooperation with the rotation stop portion constructed by the through hole 45 of the rotation stop tube 4 and the shaft body 61 of the moving body 6. In other words, the moving body 6 moves forward by itself with respect to the moving screw tube 5, at the same time when it moves forward while being accompanied by the moving screw tube 5.

Accordingly, the moving body 6 moves forward with respect to the piston 7, the collar portion 6*a* comes into contact with the rear end surface of the piston 7 so as to press the piston 7 forward, and the piston 7 moves forward. As a result, the filling material M is pushed forward so as to be moved forward (be fed), and the filling material M is discharged from the discharge ports in the front end of the applicator 1.

If the relative rotation in the one direction is further carried on, the moving body 6 moves forward for a predetermined distance, the protruding strips 52 of the moving screw tube 5 thereafter come off from the front end of the protruding strips 41*a* of the rotation stop tube 4, the screwing action of the first screw portion 8 is cancelled, and the moving screw tube 5 reaches the forward moving limit. Since the moving screw tube 5 is energized to the rear side on the basis of the contracting elastic force of the spring portion 44, in the state in which the moving screw tube 5 is at the forward moving limit, the protruding strips 52 of the moving screw tube 5 immediately approach the adjacent front ends in the rotating direction of the protruding strips 41*a* of the rotation stop tube 4 in the case that the main body tube 2 and the control tube are relatively rotated in the other direction corresponding to a retracting direction, and the screwing action of the first screw portion 8 is immediately applied.

Subsequently, if the relative rotation in the one direction is further carried on, only the screwing action of the second screw portion 9 is applied while the first screw portion 8 is energized by the spring portion 44 in such a manner as to screw-return, and the moving body 6 further moves forward. At this time, since the first screw portion 8 is energized in such a manner as to screw-return as mentioned above, the engagement and the engagement cancellation between the protruding strips 41*a* and 52 are repeated (in other words, the action that the protruding strips 41*a* and 52 come into contact with each other and come away from each other is repeated), the click feeling is applied to a user at each time of the engagement and the engagement cancellation, and the extrusion of the filling material M is detected by the user. Thereafter, the moving body 6 reaches the forward moving limit as shown in FIG. 2.

In this case of the present embodiment mentioned above, the protruding strips 41*a* and 52 generating the click feeling on the basis of the engagement and the engagement cancellation construct a pair of the click projections, and the first engagement portion 8 and the spring portion 44 construct the click mechanism.

On the other hand, if the main body tube 2 and the control tube 3 are relatively rotated in the other direction, for example, after the use, the side surfaces 54*a* (refer to FIG. 8) of the protruding strips 54 of the moving screw tube 5 come into contact with the knurling 31 of the control tube 3 so as to engage in the peripheral direction by predetermined engaging force. Accordingly, the rotation stop tube 4 and the moving screw tube 5 relatively rotate, the screwing action of the first screw portion 8 is applied, and the moving screw tube 5 moves rearward together with the moving body 6 on the basis of a cooperation with the rotation stop portion constructed by the protruding strips 54 of the moving screw tube 5 and the knurling 31 of the control tube 3.

At the same time, since the moving body 6 engages with the through hole 45 of the rotation stop tube 4 in the rotating direction, the moving body 6 and the moving screw tube 5 relatively rotate, the screwing action of the second screw portion 9 is applied, and the moving body 6 moves rearward on the basis of a cooperation of the rotation stop portion constructed by the through hole 45 of the rotation stop tube 4 and the shaft body 61 of the moving body 6. In other words, if the moving body 6 moves rearward by itself with respect to the moving screw tube 5, at the same time when it moves rearward while being accompanied by the moving screw tube 5.

If the relative rotation in the other direction is carried on, the moving body 6 moves rearward for a predetermined distance, the rear end surface of the moving screw tube 5 thereafter comes into contact with the bottom surface of the control tube 3, the screwing action of the first engagement portion 8 is stopped, and the moving screw tube 5 reaches the rearward moving limit. As a result, even if it is thereafter intended to relatively rotate the main body tube 2 and the control tube 3 in the other direction on the basis of the same operational rotating force (which means the rotating force by the user, the same being applied to the below) as that before the screwing action of the first screw portion 8 stops, the main body tube 2 and the control tube 3 are not relatively rotated.

However, for example, if the main body tube 2 and the control tube 3 are relatively rotated in the other direction on the basis of greater operational rotating force than that before the stop by the user after the screwing action of the first screw portion 8 stops, and greater rotating force than predetermined rotating force is applied between the control tube 3 and the moving screw tube 5, the protruding strips 54 bend inward in the radial direction on the basis of elasticity which the protruding strips 54 of the moving screw tube 5 have, the knurling 31 moves over the side surfaces 54*a* of the protruding strips 54 by sliding, and the control tube 3 and the moving screw tube 5 are relatively rotated (hereinafter, referred also to as "rotated idly").

As a result, even if the main body tube 2 and the control tube 3 are relatively rotated forcibly in the other direction for some reason, after the screwing action of the first screwing portion 8 stops, the protruding strips 54 function as a torque limiter, and the control tube 3 and the moving screw tube 5 are rotated idly. Accordingly, it is possible to inhibit the bottom surface of the control tube 3 from being pressed strongly to the rear side by the rearward movement of the moving screw tube 5, and it is possible to prevent such a container breakage that the engagement in the axis direction between the main body tube 2 and the control tube 3 is cancelled (the main body tube 2 and the control tube 3 are disassembled).

In this case, when the control tube 3 and the moving screw tube 5 are rotated idly, the engagement and the engagement cancellation between the protruding strips 54 and the knurling 31 (the screwing and the cancellation of screwing) are repeated, and the click feeling is applied to the user at each time of the engagement and the engagement cancellation. Accordingly, it is possible to detect the rearward moving limit of the moving screw tube 5.

As mentioned above, in the filling material extruding container 100 in accordance with the present embodiment, it is possible to move the moving body 6 forward while generating the click feeling by the first screw portion 8 of which screwing is cancelled. In addition, in this filling material extruding container 100, the through hole 45 is provided as the rotation stop portion of the second screw portion 9, in the rotation stop tube 4 engaging with the main body tube 2 in the rotating direction, and the through hole 45 is provided in the front side of the protruding strips 41*a* of the first screw portion 8 in such a manner as to engage with the front end portion of the moving body 6 in the initial state.

Accordingly, it is possible to engage in the rotating direction the through hole 45 as the rotation stop portion with the moving body 6 until the moving body 6 sufficiently moves forward. In other words, in comparison with the case that the rotation stop portion of the second screw portion 9 is provided in the control tube 3, even if the moving body 6 moves forward greatly, it is possible to engage the rotation stop portion with the moving body 6 (in other words, it is possible to elongate the forward moving limit of the moving body 6). Therefore, in accordance with the present embodiment, in the filling material extruding container 100 in which the moving body 6 can move while generating the click feeling, it is possible to secure a sufficient moving distance of the moving body 6.

Further, in the present embodiment, as mentioned above, the spring portion 44 of the click mechanism is provided by forming the slit 44*a* which extends spirally along the outer peripheral surface in the rear end portion of the rotation stop tube 4. Therefore, it is possible to form the spring portion 44 integrally with the rotation stop tube 4.

In the meantime, in the conventional filling material extruding container, there is a case that the rotation stop portion of the second screw portion 9 is inserted, as the shaft body, into the moving body 6, and in this case, it is necessary to make a size of the moving body 6 (particularly, a diameter of the moving body 6) to be a fixed level or more. In this regard, in the present embodiment, as mentioned above, the through hole 45 having the non-circular shape corresponding to the cross sectional shape of the shaft body 61 is inserted to the shaft body 61 so as to be engaged in the rotating direction, thereby constructing the through hole 45 as the rotation stop portion. Accordingly, it is not necessary to insert the rotation stop portion of the second screw portion 9 as the shaft body into the moving body 6, and it is possible to make the moving body 6 compact and thereby make the filling material extruding container 100 compact.

Further, in the present embodiment, as mentioned above, it is possible to move the piston 7 rearward by relatively rotating the main body tube 2 and the control tube 3 in the other direction. Accordingly, for example, the following operation and effect can be achieved at a storing time after use, by moving the piston 7 rearward after the use. In particular, it is possible to prevent the filling material M from flowing out of the discharge port of the applicator 1, due to a temperature change of the filling material M or an internal pressure change of the air mixed into the filling region 2*x*. Further, when such force as to bring the main body tube 2 and the control tube 3 into close contact with each other in the axis direction is applied thereto, for example, even if the moving body 6 moves forward somewhat slightly due to a clearance between the parts, it is possible to prevent the filling material M from flowing out.

The description is given above of the preferable embodiment in accordance with the present invention, however, the filling material extruding container in accordance with the present invention is not limited to the embodiment mentioned above, but may be modified in such a range which does not change the scope described in each of the appended claims or may be applied to the other.

For example, the embodiment mentioned above is provided with the protruding strips 41*a* and 52 in the first screw portion 8 as the click projections generating the click feeling, however, may be provided with the projections which do not construct the screw portion, in place thereof. It is possible to employ any engagement portion engaging with each other in such a manner as to generate the click feeling.

Further, the embodiment mentioned above is structured such that, if the main body tube 2 and the control tube 3 are relatively rotated in the one direction and the other direction, the screwing action of the second screw portion 9 is applied at the same time when the screwing action of the first screw portion 8 is applied, however, may be structured such that only the screwing action of the second screw portion 9 is applied after only the screwing action of the first screw portion 8 is applied. Further, the present invention may have only the second screw portion 9.

In addition, the male screw and the female screw mentioned above may be constructed by any structure which does the same function as the screw ridge and the screw groove such as a group of projections which are arranged intermittently, or a group of projections which are arranged spirally and intermittently, in addition to the screw ridge and the screw groove. Further, in the embodiment mentioned above, the spring portion 44 corresponding to the elastic portion of the click mechanism is formed integrally with the rotation stop tube 4, however, the elastic portion may be formed independently from the rotation stop tube 4.

Further, needless to say, the present invention can be used for a rod-like material extruding container which extrudes various rod-like cosmetic materials including, for example, a lip stick, a lip gloss, an eye liner, an eye color, an eyebrow, a lip liner, a cheek color, a concealer, a beauty stick, a hair color and the like, or a rod-shaped core of a writing instrument.

What is claimed is:

1. A filling material extruding container provided therein with a filling material and a moving body for moving said filling material, said moving body moving on the basis of a screwing action of a screw portion while generating a click feeling, if a front portion of the container and a rear portion of the container are relatively rotated, wherein the container comprises:

a rotation stop tube which is arranged within said container and engages with said front portion of the container in a rotating direction;

a moving screw tube which is arranged within said container and engages with said rear portion of the container in a rotating direction; and a click mechanism which has pairs of click projections and generates said click feeling on the basis of engagement and engagement cancellation of said pairs of the click projections, wherein one side of said screw portion is provided in said moving screw tube, the other side of said screw portion is provided on said moving body, one side of said pairs of the click projections is provided on an inner peripheral surface of said rotation stop tube, the other side of said pairs of the click projections is provided on an outer peripheral surface of said moving screw tube, said rotation stop tube has a rotation engagement portion engaging with said moving body in a rotating direction as a rotation stop portion moving said moving body in cooperation with the screwing action of said screw portion, and said rotation engagement portion is provided at a front side of said one side click projections in said rotation stop tube in such a manner as to engage with a front end portion of said moving body in an initial state, and wherein at a rear end of said rotation stop tube is provided an elastic portion energizing said moving screw tube in such a manner that said pairs of the click projections engage with each other, thereby engagement and engagement cancellation of said pairs of the click projections are made repeatedly by an elastic force of said elastic portion when said moving body is moved.

2. A filling material extruding container as claimed in claim 1, wherein said pairs of the click projections construct another screw portion which is different from said screw portion, and said moving body further moves on the basis of only the screwing action of said screw portion while generating the click feeling, after said moving body moves for a predetermined distance on the basis of the screwing actions of said screw portion and said other screw portion, if said front portion of the container and said rear portion of the container are relatively rotated.

3. A filling material extruding container as claimed in claim 1, wherein said moving screw tube is provided with protruding portions engaging with said rear portion of the container in the rotating direction, and said protruding portions have elasticity in a radial direction to cancel the engagement with said rear portion of the container in the case that said rear portion of the container and said moving screw tube are relatively rotated by greater rotating force than predetermined rotating force.

4. A filling material extruding container as claimed in claim 1, wherein said elastic portion comprises a slit extending spirally along an outer peripheral surface in the rear end portion of said rotation stop tube.

5. A filling material extruding container as claimed in claim 1, wherein said moving body is formed in a columnar shape having a non-circular cross sectional shape and extending in an axis direction, and said rotation engagement portion has a through hole portion to which said moving body is inserted and which is formed in a non-circular shape corresponding to the cross sectional shape of said moving body.

6. A filling material extruding container as claimed in claim 2, wherein said moving screw tube is provided with protruding portions engaging with said rear portion of the container in the rotating direction, and said protruding portions have elasticity in a radial direction to cancel the engagement with said rear portion of the container in the case that said rear portion of the container and said moving screw tube are relatively rotated by greater rotating force than predetermined rotating force.

7. A filling material extruding container as claimed in claim 2, wherein said elastic portion comprises a slit extending spirally along an outer peripheral surface in the rear end portion of said rotation stop tube.

8. A filling material extruding container as claimed in claim 3, wherein said elastic portion comprises a slit extending spirally along an outer peripheral surface in the rear end portion of said rotation stop tube.

9. A filling material extruding container as claimed in claim 2, wherein said moving body is formed in a columnar shape having a non-circular cross sectional shape and extending in an axis direction, and said rotation engagement portion has a through hole portion to which said moving body is inserted and which is formed in a non-circular shape corresponding to the cross sectional shape of said moving body.

10. A filling material extruding container as claimed in claim 3, wherein said moving body is formed in a columnar shape having a non-circular cross sectional shape and extending in an axis direction, and said rotation engagement portion has a through hole portion to which said moving body is inserted and which is formed in a non-circular shape corresponding to the cross sectional shape of said moving body.

11. A filling material extruding container as claimed in claim 4, wherein said moving body is formed in a columnar shape having a non-circular cross sectional shape and extending in an axis direction, and said rotation engagement portion has a through hole portion to which said moving body is inserted and which is formed in a non-circular shape corresponding to the cross sectional shape of said moving body.

* * * * *